US006931966B2

(12) United States Patent
Monroig et al.

(10) Patent No.: US 6,931,966 B2
(45) Date of Patent: Aug. 23, 2005

(54) ADJUSTABLE SOCKET

(75) Inventors: Julio H. Monroig, Sebastian, PR (US); Juan Alicea, Quebradillas, PR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/611,825

(22) Filed: Jul. 1, 2003

(65) Prior Publication Data

US 2005/0000327 A1 Jan. 6, 2005

(51) Int. Cl.[7] ..... B25B 13/06
(52) U.S. Cl. ..... 81/121.1; 81/180.1; 81/185.2
(58) Field of Search ..... 81/52, 121.1, 125, 81/180.1, 185.2

(56) References Cited

U.S. PATENT DOCUMENTS

| | | | | | |
|---|---|---|---|---|---|
| 3,087,364 | A | * | 4/1963 | Witmer | 81/52 |
| 3,471,160 | A | * | 10/1969 | Sabo | 81/52 |
| 4,520,698 | A | | 6/1985 | Martinmaas | |
| 4,757,729 | A | | 7/1988 | Martinmaas | |
| 6,000,300 | A | | 12/1999 | Plamondon | |
| 6,779,423 | B2 | * | 8/2004 | Hammons et al. | 81/125 |

* cited by examiner

*Primary Examiner*—James G. Smith

(57) ABSTRACT

An adjustable socket operates to rotatably drive a fastener. The adjustable socket includes a first recess disposed in the socket receptive of the fastener; and an adjustable stopper disposed in a second recess of the adjustable socket for limiting penetration of the fastener into the first recess.

15 Claims, 3 Drawing Sheets

ADJUSTABLE SOCKET

BACKGROUND

One of the most common tools used by laymen and mechanics alike is a tool known as a socket wrench. Typically, this tool includes a ratchet lever arm and a number of differently sized, cylindrical sockets that attach to the lever arm. The sockets engage and fit over a nut or bolt head so that the nut or bolt can be tightened or loosened by rotation of the lever arm, which, in turn, rotates the socket and the nut or bolt.

A socket wrench tool set may also include length and swivel adapters that can be connected between the lever arm and the socket. The differently sized, cylindrical sockets are typically organized as a set to accommodate nuts and bolts of various sizes. Socket sets are usually found in both standard "English" and metric sizes.

Each socket includes a recess that receives the nut or the head of the bolt that is to be tightened or loosened. This recess is typically polygonal in shape, for example, hexagonal. Often the recess extends relatively deeply into the socket. This allows the socket to accommodate nuts and bolts of various heights.

A relatively deep recess in the socket that can accommodate a thick nut or a bolt head, plus perhaps a portion of the bolt shaft, is convenient for most applications. However, such a deep recess can also allow the end of the socket to come into contact with the surface of the work piece to which the nut or bolt is secured. Depending on the nature of this work piece, contact with the end of the socket can cause damage that is problematic. For example, a nut or bolt may be secured to a component or work piece that has a very sensitive surface that may be damaged by direct contact with the end of the socket of a socket wrench, particularly if force is applied to the socket to engage and rotate the nut or bolt. An example of such a sensitive surface is that of a printed circuit board or printed circuit assembly.

As shown in FIG. 1, when a typical socket (100) is used to secure a nut (102) to a bolt (104) of a printed circuit board or assembly (106), a face (108) of the socket (100) will generally contact the printed circuit board (106). Unfortunately, the printed circuit assembly (106) is easily scratched and damaged by direct contact with the socket (100), which is usually made of metal. The damage caused by the socket (100) is represented by a ring (110) shaped by the face (108) of the socket (100) as the face (108) of the socket (100) scratches the printed circuit assembly (106) during rotation to tighten or loosen the nut (102). The damage caused by the typical socket (100) may render the printed circuit assembly (106) useless in some instances.

Consequently, other, less convenient tools may be selected to tighten or loosen a nut securing a bolt through a printed circuit assembly. One example of such a tool that can be used in place of a socket wrench is a set of pliers. However, using a set of pliers still requires that time and care must be taken to avoid scratching the surface of the printed circuit assembly. In fact, the time taken will likely be significant more than would have been required to tighten or loosen the nut (102) with a socket wrench.

SUMMARY

An adjustable socket operates to rotatably drive a fastener. The adjustable socket includes a first recess disposed in the socket receptive of the fastener; and an adjustable stopper disposed in a second recess of the adjustable socket for limiting penetration of the fastener into the first recess.

BRIEF DESCRIPTION OF THE DRAWINGS

The accompanying drawings illustrate various embodiments of the present invention and are a part of the specification. The illustrated embodiments are merely examples of the present invention and do not limit the scope of the invention.

Throughout the drawings, identical reference numbers designate similar, but not necessarily identical, elements.

DETAILED DESCRIPTION

This specification describes an adjustable socket and methods for making and using adjustable sockets. One particular application of the principles described herein is use of an adjustable socket to assemble or disassemble a printed circuit assembly (PCA).

As mentioned above, there are often sensitive components of PCAs that can be damaged or destroyed by direct contact with a socket. Therefore, sockets according to the principles described herein facilitate adjustment of socket recesses to prevent contact between the socket and the PCA or any other component that may be assembled or disassembled with the aid of a socket. According to the principles described herein, an adjustable socket can be manipulated to accommodate fasteners of any size and depth and still eliminate contact between the socket and any adjacent component or work piece.

However, the principles described herein are not limited to a PCA environment. The principles described may be applied to any other situation utilizing a socket according to particular needs where a sensitive component or surface may be damaged by the socket.

As used in this specification and the appended claims, the term "socket" is used broadly to mean any device with an opening or recess into which a portion of a fastener is fitted or engaged for manipulation or movement of that fastener. The embodiments described below illustrate one possible embodiment of an adjustable socket implementing the principles described herein. However, it will be understood that the embodiment described here is merely exemplary in nature. As used in this specification and the appended claims, the term "fastener" is used broadly to refer to a nut, a bolt, a nut and bolt combination or other fastening device that might be manipulated with a socket.

Figure 2:
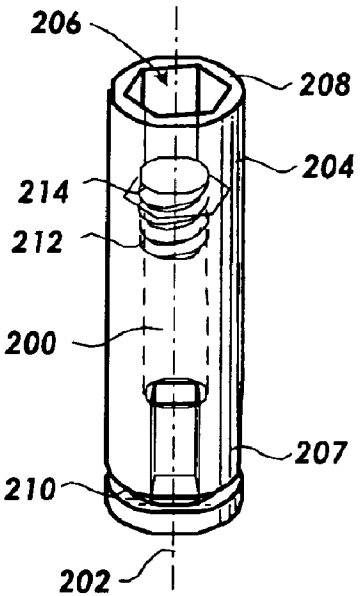
FIG. 2 is a perspective view of an adjustable socket according to one embodiment of the present invention.

Referring now to the figures, and in particular FIG. 2, an embodiment of an adjustable socket is described. The adjustable socket includes a driver (200) that may be made of any structural material. For example, the driver (200) may be fabricated from a metal alloy such as stainless steel or other materials.

The driver (200) is rotatable about a longitudinal axis (202) extending through the driver (200). The driver (200) is generally cylindrical as is shown in the embodiment of FIG.

Figure 1:
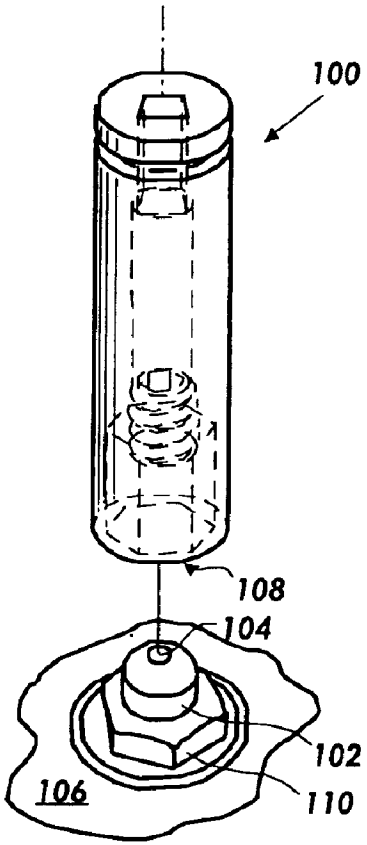
Fig. 1 (PRIOR ART)
FIG. 1 is a perspective view of a standard socket shown in relation to a printed circuit assembly.

2. However, any polygonal or irregular shape may also be used according to particular needs and requirements. In addition, the driver (200) may be of any length and width to accommodate any fastener, such as the nut (102) shown with reference to FIG. 1.

The driver (200) has a first end (204) associated with a first recess (206). The first recess extends from the first end (204) into the body of the driver (200). The first recess (206) typically extends along the longitudinal axis (202) of the driver (200). The first recess (206) may have a polygonal shape. For example, the first recess (206) may have a regular hexagonal shape as shown at the top of FIG. 2. Hexagonal shapes are common for nuts. However, other shapes are also known.

The first recess (206) of FIG. 2 is sized to receive a nut of corresponding size and shape. For a nut or bolt head of another size, a different socket is selected, typically from a set of sockets having a range of sizes, each of which is adjustable according to the principles described herein. The first recess (206) includes a depth represented by a dimension (d), which is most readily seen in the cross-sectional view of FIG. 3. The first recess (206) may be coaxial with the longitudinal axis (202) of the driver (200) as shown, but this is not necessarily so.

The driver (200) also has a second end (207) that includes structure for coupling the driver (200) to the lever arm of a socket wrench or to a power tool (215, FIG. 3) for rotating the driver (200). For example, the second end (207) may include a coupling hole, such as a square hole, into which a tab of the lever arm or power tool extends and couples to the driver (200). Additionally, the driver (200) may have a circumferential slot (210) for engagement with the lever arm of a wrench or a power tool (215, FIG. 3). Any coupling mechanism, or, in some embodiments, no coupling mechanism at all, may be used by those of skill in the art having the benefit of this disclosure to facilitate a mechanical advantage for rotating the driver (200).

Figure 4:
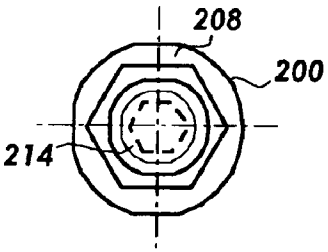
FIG. 4 is a top view of the adjustable socket of FIG. 2.

Referring again to FIG. 3, the socket also includes a second internal recess (212) formed in the driver (200) adjacent to the first polygonal recess (206). In the example illustrated, the second recess (212) is coaxial with the longitudinal axis (202) of the driver (200) as shown, but this is not necessarily so. According to FIG. 3, the second recess (212) is generally cylindrical and threaded internally. The second recess (212) may be smaller in diameter than the first recess (202) according to FIGS. 2–4.

Figure 3:
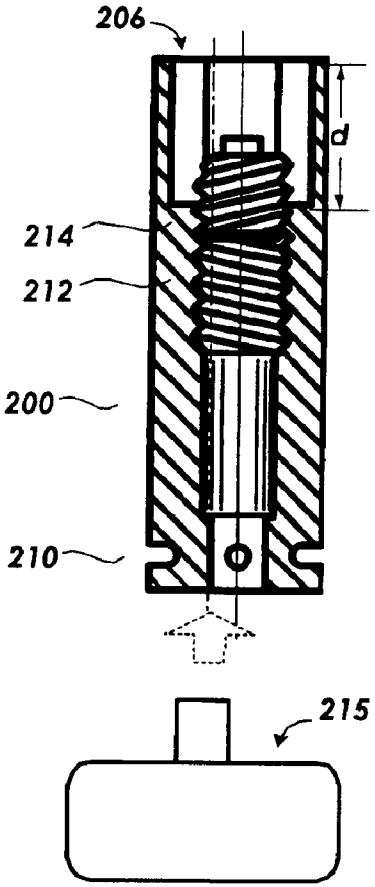
FIG. 3 is a cross-sectional view of the adjustable socket of FIG. 2.

The second recess (212) is receptive of a stopper (214) that is shown in FIG. 3 disposed in the second recess (212) of the driver (200). According to the embodiment of FIGS. 2–4, the stopper (214) is a set screw. This set screw (214) includes matched threading to engage the threading of the second recess (212). The threading between the set screw (214) and the second recess (212) facilitates axial movement (i.e. movement substantially in either direction of the longitudinal axis (202)) of the set screw (214) within the driver (200) upon relative rotation therebetween.

In the illustrated example, the set screw (214) is sized such that it fits inside the first hexagonal recess (202) with a small clearance permitting rotation. This is best seen in the top view of FIG. 4. Accordingly, the set screw (214) may be adjusted by threading the set screw (214) into or out of the second threaded recess (212) to limit the depth (d) of the first recess (206) and therefore the extent of penetration of any nut or bolt head the driver (200) may engage in the first recess (206).

Figure 5:
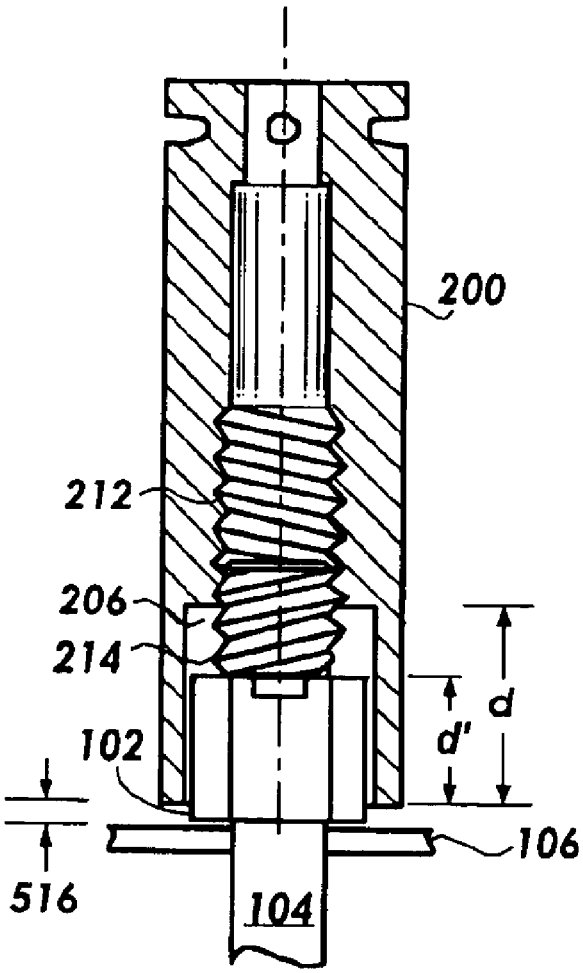
FIG. 5 is a side view of the adjustable socket of FIG. 2 shown in relation to a printed circuit assembly.

For example, as shown in FIG. 5, the driver (200) may be used to engage a nut (102) associated with a PCA (106). The set screw (214) may be adjusted to protrude into the first recess (206, FIGS. 2–3) and reduce the depth (d) of the first recess (206) to no more than the depth of the nut (102).

According to FIG. 5, the depth (d) of the recess (206) is reduced to something less than the depth of the nut (102) as represented by (d'). Therefore, a gap (516) is maintained between a face (208) of the driver (200) and the PCA (106) or other work piece being secured. Consequently, there will be no scratching or other damage done to the surface of the PCA (106) from using the driver (200). Thus, the driver (200) offers the convenience of a socket operable to rotatably drive a nut or bolt, without the drawbacks of conventional sockets that often directly interfaced with and damaged components that are sensitive to such damage.

The set screw (214) may be adjusted in a number of ways to change the depth (d) of the first recess (206). One way to adjust the set screw (214) is to insert a tool such as an Allen wrench or a screwdriver or other tool into the second recess (212) through the second end (207) of the driver (200). In such an example, the set screw (214) and second recess (212) communicate with the hole in the second end (207) of the driver. As described above, this hole may be used for coupling the driver (200) to a wrench lever arm or power tool as shown in FIG. 3.

The Allen wrench, screwdriver or other tool may engage and rotate the set screw (214) to provide the desired depth (d) for the first recess (206). Inserting an Allen wrench or other tool through the second end (207) of the driver (200) offers the advantage of enabling adjustment of the set screw (214) visually with the driver (200) in place over the nut (102) or bolt head. The operator can hold the driver (200) in a position maintaining the desired gap (516), and adjust the set screw (214) until that gap is ensured by the position of the set screw (214) within the first recess (206).

Another way the set screw (214) may be adjusted is by inserting an Allen wrench, screw driver or other tool into the first recess (206) in the first end (204). In such a case, the first recess (206) provides access to the set screw (214). Again, the Allen wrench, screwdriver or other tool, may engage and rotate the set screw (214) to provide a desired depth (d) for the first recess (206). However, adjustments cannot be made via the first recess (206) if the driver is in place over the nut (102) or bolt head.

As mentioned above, the socket may be made from structural materials, for example, stainless steel or other alloys. A socket fabrication process, according to the principles described herein, may include fabricating the driver (200) from such materials to form the driver shown as in FIGS. 2–5.

For example, the driver (200) may be fabricated in a generally cylindrical shape such that the driver (200) is rotatable around the longitudinal axis (202). The fabrication process may include extruding, molding, forging, stamping, or other processes.

The first and second recesses (206 and 212) are preferably formed during fabrication of the body of the driver (200). The second recess (212) may also be threaded during the fabrication of the body of the driver (200).

Alternatively, the first and second recesses (206 and 212) may be formed, and the second recess (212) threaded, following fabrication of the body of the driver (200). This subsequent formation of the recess (206 and 212) may be performed with the aid of punches, dies, or other tools.

When the driver (200) is completed with the first and second recesses (206 and 212) shaped and threaded, respectively, the set screw (214) or other stopper is inserted into the second recess (212). As discussed above, the set screw (214) is threaded to mate with the threading of the second recess (212) and facilitate adjustment of the depth (d, FIG. 3) of the first recess (206).

While the figures and description discussed above have reference to a single socket, it will be understood that sets of various-sized sockets may also be made according to the principles described herein. In other words, each socket in such a set is individually adjustable as to the depth of the first recess that receives the nut or bolt head being engaged.

The sockets may be made to accommodate nuts of any size and shape. For example, in addition to the hexagonal shape shown in FIG. 2, the sockets may include recesses receptive of square nuts, flare nuts, star nuts, or nuts of any other shape. The sockets may also include recesses of universal shapes that are capable of receiving and driving nuts of many different shapes, for example a 12 or 24-point recess. Further, the sockets may include English or metric graduations.

The preceding description has been presented only to illustrate and describe embodiments of the invention. It is not intended to be exhaustive or to limit the invention to any precise form disclosed. Many modifications and variations are possible in light of the above teaching. It is intended that the scope of the invention be defined by the following claims.

What is claimed is:

1. An adjustable socket comprising:

a driver rotatable around a longitudinal axis and having a first end;

a polygonal recess disposed in said first end of said driver;

a second recess adjacent said polygonal recess; and a stopper disposed in said second recess, said stopper being adjustable so as to extend from said second recess at any of a range of different distances into said polygonal recess;

wherein said stopper is threaded into said second recess and adjustable into and out of said polygonal recess.

2. The socket of claim 1, wherein said polygonal recess comprises a hexagonal recess.

3. An adjustable socket comprising:

a driver rotatable around a longitudinal axis and having a first end;

a first recess disposed in said first end of said driver for receiving a fastener to be driven;

a second recess adjacent said first recess; and a stopper disposed in said second recess and adjustably extending into said first recess;

wherein said second recess is a threaded recess.

4. The socket of claim 3, wherein said stopper comprises a set screw having threads engaging said second recess.

5. The socket of claim 1, wherein said second recess comprises a diameter smaller than said polygonal recess.

6. The socket of claim 1, wherein said polygonal recess and said second recess are coaxial with said longitudinal axis of said driver.

7. The socket of claim 1, wherein said driver comprises a second end receptive of a wrench lever arm.

8. The socket of claim 1, wherein said driver comprises a second end receptive of a power tool.

9. The socket of claim 1, wherein said driver comprises stainless steel.

10. An adjustable socket operative to rotatably drive a fastener comprising:

a first recess disposed in said socket receptive of said fastener; and an adjustable stopper disposed in a second recess of said adjustable socket for limiting penetration of said fastener into said first recess;

wherein said fastener is a nut and said adjustable stopper prevents penetration of said nut into said first recess to no more then a thickness of said nut.

11. An adjustable socket operative to rotatably drive a fastener comprising:

a first recess disposed in said socket receptive of said fastener; and an adjustable stopper disposed in a second recess of said adjustable socket for limiting penetration of said fastener into said first recess;

wherein said adjustable stopper and said second recess comprise mating threads.

12. The adjustable socket of claim 11, wherein said adjustable stopper is movable longitudinally along said socket in response to relative rotation between said stopper and said socket.

13. An adjustable socket operative to rotatably drive a fastener comprising:

engagement means for engaging said fastener; and stopper means for limiting penetration of said fastener into said engagement means;

wherein said fastener is a nut and said stopper means are adjusted to prevent penetration of said nut into said engagement means to no more than a thickness of said nut.

14. An adjustable socket operative to rotatably drive a fastener comprising:

engagement means for engaging said fastener; and stopper means for limiting penetration of said fastener into said engagement means;

wherein said stopper means are adjustable so as to selectively limit penetration of said fastener into maid engagement means to any of a plurality of different distances;

wherein said stopper means comprise an adjustable stopper disposed in a recess or said adjustable socket for limiting penetration of said fastener into said engagement means; and wherein said adjustable stopper and said recess comprise mating threads.

15. The adjustable socket of claim 14, wherein said adjustable stopper is movable longitudinally along said socket in response to relative rotation between said stopper and said socket.

* * * * *